US009284957B2

(12) United States Patent
Jaeshke

(10) Patent No.: US 9,284,957 B2
(45) Date of Patent: Mar. 15, 2016

(54) UNDERWATER CONVEYING ASSEMBLY WITH A PUMP AND WITH A DRIVE DEVICE

(75) Inventor: Axel Jaeshke, Minden (DE)

(73) Assignee: ITT Bornemann GmbH, Obernkirchen (DE)

( * ) Notice: Subject to any disclaimer, the term of this patent is extended or adjusted under 35 U.S.C. 154(b) by 681 days.

(21) Appl. No.: 13/166,840

(22) Filed: Jun. 23, 2011

(65) Prior Publication Data

US 2011/0318201 A1 Dec. 29, 2011

(30) Foreign Application Priority Data

Jun. 29, 2010 (DE) ..... 10 2010 026 239

(51) Int. Cl.
*F04B 47/06* (2006.01)
*F04B 17/03* (2006.01)

(52) U.S. Cl.
CPC ..... *F04B 47/06* (2013.01); *F04B 17/03* (2013.01)

(58) Field of Classification Search
CPC ..... F04B 47/06; F04B 53/16; F04B 53/08; F04D 13/08; F04D 13/086; F04D 13/10; F04C 13/008; F04C 15/0096
USPC ..... 417/321, 423.3, 302, 366, 442
See application file for complete search history.

(56) References Cited

U.S. PATENT DOCUMENTS 1,651,881 A * 12/1927 Frickey et al. ..... 415/112
2,404,635 A * 7/1946 Hoover ..... 417/360
3,652,186 A * 3/1972 Carter ..... 417/370
3,664,136 A * 5/1972 Laval et al. ..... 405/60
3,677,665 A 7/1972 Corkill
4,765,745 A * 8/1988 Strecker ..... 366/76.6
6,140,725 A * 10/2000 Jensen et al. ..... 310/87
6,200,108 B1 * 3/2001 Caudill ..... F04D 13/06 165/47
2007/0274849 A1 * 11/2007 Martinez ..... 417/423.3
2010/0150739 A1 * 6/2010 Brookbank ..... E21B 36/001 417/53

FOREIGN PATENT DOCUMENTS

DE 37 21 398 1/1988
DE 100 81 956 12/2000
DE 10 2008 018 407 10/2009

* cited by examiner

*Primary Examiner* — Nathan J Newhouse
*Assistant Examiner* — Philip Stimpert
(74) *Attorney, Agent, or Firm* — Whitham, Curtis, Christofferson & Cook, P.C.

(57) ABSTRACT

The invention relates to an underwater conveying assembly with a pump (2) and with a drive device (3), in which the drive device (3) is sealed off with respect to the surrounding water and with respect to a process medium, the pump (2) and the drive device (3) being combined into a module (4), and the pump (2) having at least one inlet port (21) and at least one outlet port (22), the module (4) being assigned a collecting element (5), which tapers preferably in the direction of the inlet port (21), at least one suction lance (7) being flow-connected to the inlet port (21). It is possible to change over to a punctiform inlet port which precedes the collecting element (5).

14 Claims, 1 Drawing Sheet

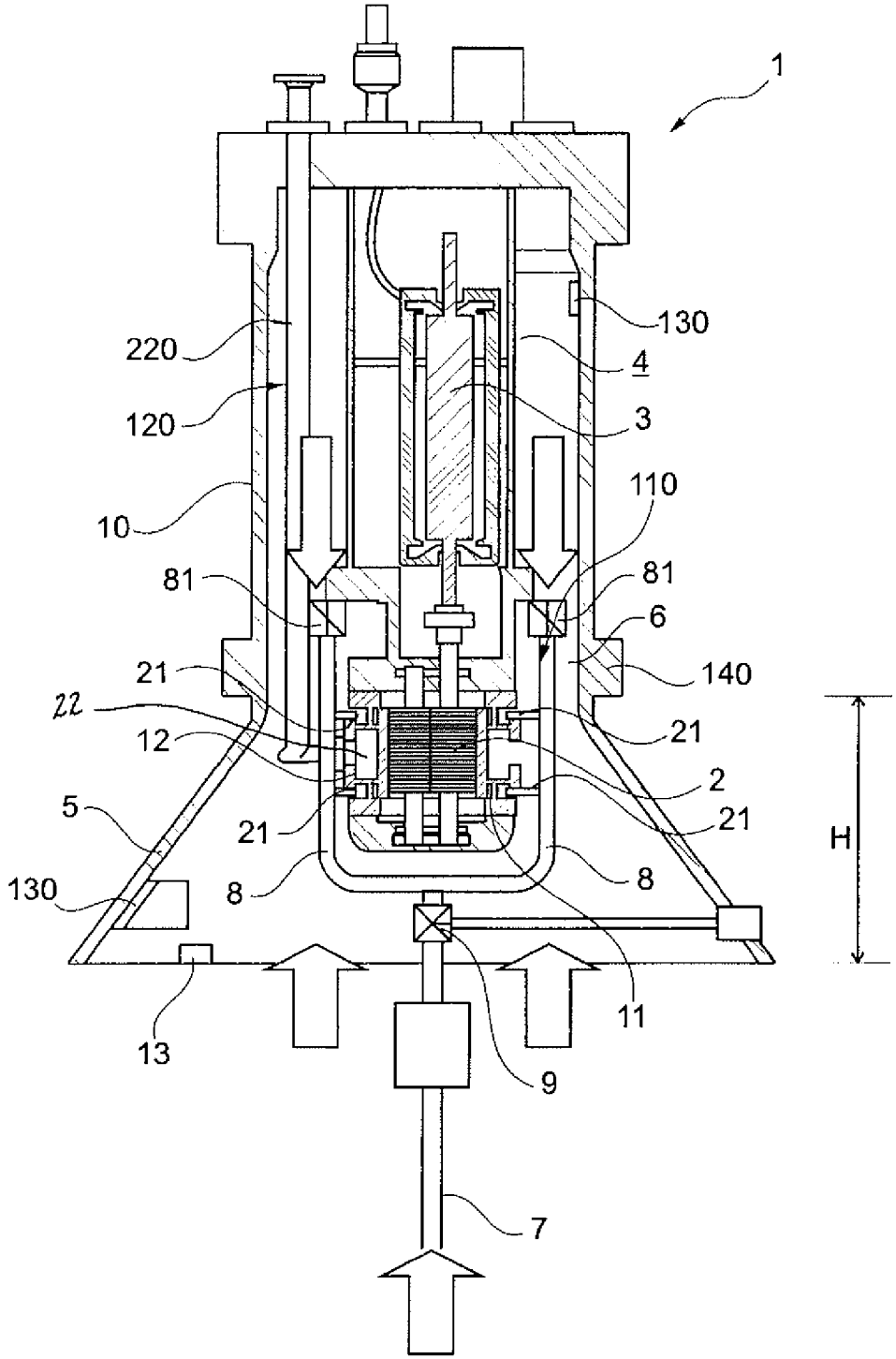
1
130
220
4
120
3
110
10
81
81
6
140
21
22
21
12
2
5
21
21
H
130
8
8
11
13
9
7

UNDERWATER CONVEYING ASSEMBLY WITH A PUMP AND WITH A DRIVE DEVICE

The invention relates to an underwater conveying assembly with a pump and with a drive device, in which the drive device is sealed off with respect to the surrounding water and with respect to a process medium, the pump and the drive device being combined into a module, and the pump having at least one inlet port and at least one outlet port. The conveying assembly is provided, in particular, for the conveyance of hydrocarbons in a deep-sea environment and is designed for this purpose.

BACKGROUND

DE 37 21 398 A1 describes a conveying assembly composed of a pump with a drive device, the pump being surrounded on all sides by a pump casing which has a suction space with an intake port and a pressure space with an outlet port. The pump casing is designed to be water-tight and is connected to a motor casing which is likewise designed to be water-tight, receives the drive device and encloses a motor space which surrounds the encapsulated drive unit and is divided off, liquid-tight, with respect to the suction space. The motor space is filled with a barrier medium, in this case with oil, which serves for lubricating the bearings, any gearwheels or the like and acts upon the seals and discharges the heat via the motor casing into its surroundings. Such underwater conveying devices are used in the ocean for the conveyance of hydrocarbons.

In crude oil and natural gas production in the ocean, deposits are being developed at ever greater water depths, in this context water depths of up to 4000 m are not uncommon. Correspondingly, the pipeline systems and conveying assemblies also have to fulfill increasingly stringent requirements in respect of resistance to hydrostatic pressures from outside, caused by the water column, and from inside, caused by the reservoir pressure of the crude oil and natural gas. Usually, pipeline systems for deep-sea conveyance are designed for an internal excess pressure of 300 to 500 bar and have to withstand an external excess pressure of up to 400 bar depending on the water depth.

Additional challenges are that the temperatures of the surrounding water and those of the conveyor process medium are different, thus, while the water temperature lies between 1 and 4° C., the temperature of the process medium will rise to above 100° C., so that correspondingly high thermal loads occur, and also the formation of ice has to be taken into account in the case of gas hydrates. All the components integrated into a conveying system must be capable of withstanding at least the loads set out above.

Pump systems for the deep-sea conveyance of hydrocarbons are usually designed such that the pump and the drive device, such as a motor and clutch, are installed in a common casing. It is thereby possible to dispense with a technically critical shaft leadthrough from the pump casing to the motor casing. In this case, there is a region filled by the process medium, to be precise the suction space, the conveying chambers of the pump and the pressure space, and there is a region not filled by the process medium, with the motor, bearing and clutch. The two regions are separated from one another by a shaft seal; the region not filled with the process medium, with the motor, bearing and clutch space, is filled with a barrier medium, usually with water or oil.

The joint conveyance of crude oil and natural gas means that liquids and gases are transported next to one another. In crude oil/natural gas conveyance, a multiphase mixture, as it is known, is conveyed, where there is a high likelihood of the temporary presence of only one phase, that is to say only liquids or only gaseous components are conveyed for considerable periods of time. Furthermore, the composition of the multiphase mixture fluctuates over a wide range and over relatively long periods of time, and therefore pump technology has to fulfill special requirements here.

If hydrocarbons emerge in an uncontrolled way, it is necessary to intercept these as near to the outlet point and as completely as possible, in order to reduce or avoid environmental pollution and intercept the emerging conveyable or process medium as completely as possible.

DE 10 2008 018 407 A1 describes a generic underwater conveying assembly in which a pressure casing is filled with the process medium and surrounds the module which is combined in a module casing.

DE 100 81 956 T1 describes a vibratory pump having a frame group with a drive solenoid accommodated in the frame group. A transmission group with an element oscillating axially with respect to the frame group is provided, the oscillating element being attached with one end to the drive solenoid. The pump is designed as a submersible pump with an inlet arranged at the lower end on the end face. The medium to be conveyed is conveyed through a passage resembling an annular gap to the pump outlet via an auxiliary pump chamber and pump outlets emanating from the latter. Such a pump is preferably provided as a shaft pump. An attachment with a cylindrical upper portion and with a lower conical portion which has water inlet ports is provided so that the pump can be used as a suction pump. Use at great depths or for the conveyance of hydrocarbons is not provided or is not possible.

SUMMARY

The object according to the present invention is to provide an underwater conveying assembly which is adapted to special conveying situations and, in particular, can effectively receive and transport away hydrocarbons which emerge in a uncontrolled way.

This object is achieved according to the invention by means of an underwater conveying assembly having the features of the main claim. Advantageous refinements and developments of the invention are listed in the subclaims, the description and the figures.

The underwater conveying assembly according to the invention with a pump and with a drive device, in which the drive device is set down above the surrounding water and with respect to a process medium, the pump and the drive device being combined into a module and having at least one inlet port and at least one outlet port, makes provision whereby the module is assigned a collecting element, for example a collecting funnel or a collecting bell, which can taper in the direction of the inlet port. By a collecting element, for example a funnel, being provided, it is possible to surround a relatively large area and a relatively large volume around the outlet point, so that a process medium, in particular hydrocarbons and natural gas, located at an outlet point and in the immediate vicinity around it can easily be collected and can be conducted to the at least one inlet port of the pump. The conveying activity of the pump gives rise to a pressure drop in the region of the inlet port, so that both the surrounding water and the emerging process medium move in the direction of the inlet port. The surrounding water is kept away as far as possible since the collecting element has a dosed design, so that, depending on the leaktightness of the collecting element, a virtually complete reception of the emerging medium can take place in the region around the outlet point. At least one suction lance which advantageously projects beyond the height of the collecting element is flow-connected to the inlet port, thus affording the possibility of acquiring a direct tie-up to an outlet port. The suction lance may be arranged in a stable way inside the collecting element, collecting bell or collecting funnel, so that, by the underwater conveying assembly being lowered into an outlet port, a large part of the medium flowing out can be intercepted by the suction lance. The medium to be conveyed can then be transported away from the suction lance by the pump. The collecting element collects the process medium and leads it to the inlet port.

The collecting element may form a collection space or issue into a collection space, so that the medium to be pumped away is not conducted directly into the inlet port by guide devices or a funnel, but, instead, a collection space is provided for steadying and, if appropriate, segregating the medium to be conveyed. The collection space may be designed as an annular space around the module and may extend along the module. The module can thus be fitted into a bell-like or sleeve-like hood and be aligned so as to be oriented concentrically inside the hood.

One or more suction pipes may be connected to the inlet port and may issue into the collection space, so that pipeline transport from the collection space or the collecting element to the inlet port on the pump casing is provided.

The suction pipe and the suction lance may be flow-connected to one another so that the medium can be transported to the inlet port around the pump casing from both pipelines, that is to say the suction lance and the suction pipe.

An adjustable valve may be provided which controls the distribution of the throughflow quantity from the suction pipe and the suction lance to the inlet port. The varying conditions during conveyance can thereby be taken into account. If especially productive conveyance via the suction lance occurs, the valve can reduce the supply from the suction pipe, and, if there is a high concentration of admixtures or hydrocarbons inside the collection space, a corresponding increase in the throughflow quantity of the suction pipe or suction pipes can be provided.

Sensor devices for detecting the temperature, in particular on or in the collecting element, the outlet pressure of the pump and/or the concentration of admixtures, in particular hydrocarbons in the surrounding water, may be provided, in order to regulate the conveying capacity or throughflow quantities. Position control may also take place on the basis of the concentration of admixtures, so that the underwater conveying assembly can be positioned optimally without visual contact.

Devices for treating the process medium, for the separation of solids and/or for the supply of aggregates or inhibitors may be assigned to the collecting element.

The pump is preferably designed as a screw spindle pump, a recirculation line from a pressure space of the pump to the suction space of the pump being provided, through which a separated liquid phase is delivered to the suction space in a metered way, in order to avoid dry running in the event of a predominant conveyance of gas phases.

Should the medium emerge at high pressure, pumping may be unnecessary, and therefore the inlet side and the outlet side of the underwater conveying assembly are connected to one another by means of at least one nonreturn valve, so that a free passage of the process medium, even when the pump is not activated, is ensured.

Heating devices may be assigned to the collecting element or the collection space in order to avoid the formation of ice by gas hydrates. The drive device and the pump itself, which discharge heat into the surroundings on account of efficiency losses, may also be used as a heating device.

Anchoring devices may be arranged on the collecting element or a casing, for example for forming the collection space, in order to allow stable anchoring on the ocean floor in the region of the outlet point for, for example, hydrocarbons.

DESCRIPTION OF THE DRAWINGS

An exemplary embodiment of the invention is explained in more detail below by means of the single FIGURE (FIG. 1). The FIGURE shows a diagrammatic sectional illustration of an underwater conveying assembly 1 in an operational alignment. In the operational alignment, the longitudinal extent of the underwater conveying assembly 1 is oriented essentially vertically, and the following orientation data relate to the customary operational alignment, such as is illustrated in the FIGURE.

DETAILED DESCRIPTION

The underwater conveying assembly 1 has a pump 2 in the form of a multispindle screw pump which is driven via a drive device 3 in the form of an electric motor. The drive device 3 is sealed off both with respect to the water surrounding the underwater conveying assembly 1 and with respect to the process medium to be conveyed, for example hydrocarbons or a mixture of surrounding water and hydrocarbons. The pump 2 and the drive device 3 are combined into a module 4, and the pump 2 and the drive device 3 may be arranged in a common module casing. The pump 2 has a plurality of inlet ports 21, in this case four inlet ports 21, which, in the exemplary embodiment illustrated, are connected to supply lines, via which the process medium to be conveyed is delivered to the inlet ports 21. The pump 2 likewise has an outlet port 22 which is coupled to a pipeline 220 in order to convey the process medium away, in particular to convey it to a further-processing station. In the further-processing station, for example, the process medium can be separated from the surrounding water which has been conveyed along with it.

The module 4 composed of the drive device 3 and pump 2 has an elongate, essentially cylindrical outer contour and is surrounded by a casing 10 which is arranged essentially concentrically to the module 4. Between the casing 10 and the module 4 is formed an annular space 6 which is designed as a collection space and extends over the entire length of the module 4. The casing 10 widens downwardly in a funnel-shaped way, so as to form a closed collecting element 5 in the form of a funnel, the height H of which is measured such that it projects beyond the lower end of the pump 2. Instead of a funnel, other geometric shapes may also be provided for the collecting element 5, for example a bell shape, pyramid shape, conical shape or more or less cylindrical sleeve shape, a taper in the direction of the inlet port 21 preferably being present. The collecting funnel 5 tapers in the direction of the inlet ports 21, so that the process medium which flows into the collecting funnel 5 is conducted in the direction of the inlet ports 21. The volume of the collecting funnel 5 is part of the collection space 6. In an alternative refinement, the collecting funnel may form the collection space.

Into that part of the collection space 6 which resembles an annular space extend pipelines which are designed as suction pipes 8. In the exemplary embodiment illustrated, the suction pipe 8 is of U-shaped design and has branch lines in the direction of the inlet ports 21. The upper ends of the U-shaped suction pipe 8 project into the annular part of the collection space 6 and lie next to the pump 2 and the drive device 3. In the exemplary embodiment illustrated, the suction pipe 8 terminates approximately level with the interface between the drive device 3 and the pump 2. A suction lance 7 issues in the region of the connecting leg of the U-shaped suction pipe 8. The suction lance 7 projects beyond the lower end of the collecting funnel 5 and can therefore be introduced into a conveying hole or the like. Arranged in the suction lance 7 is an adjustable valve 9, via which the distribution of the throughflow quantities can be varied. If no process medium is to arrive at the pump through the suction lance 7, the valve 9 is closed, and if large quantities are to be transported to the inlet ports 2 through the suction lance 7, the valve 9 is opened completely. As seen in flow terms the inlet side 110 is located upstream of the screw spindles 2, and, as seen in flow terms, the outlet side 120 is located downstream of these. A bypass valve, not illustrated, can bridge the screw spindles 2, so that a direct flow from the inlet side 110 to the outlet side 120 can take place when no additional pressure is to be built up.

The suction pipe 8 may be equipped at its upper ends with inlet valves 81 which may likewise be designed adjustably. By the setting of the respective valves 9, 81, those fractions which are conveyed away via the collection space 6 or the suction lance 7 can be set.

The collection space 6 is heated in the region of the annular space around the module 4 by the waste heat from the drive device 3 and the pump 2 during operation, so that the process medium can be kept above the stability temperature of gas hydrates. In addition, heating devices 130 may be arranged on the collecting funnel 5 or in the region of the collection space 6. Devices for the supply of inhibitors may likewise be provided, in order to prevent icing-up or blockage of the inlet ports or valves 81, 9.

Sensors 13 may be provided which detect the fraction of hydrocarbons in order to make it possible to position the underwater conveying assembly 1 exactly above the outlet point of hydrocarbons. Pressure measurement devices may likewise be provided at the outlet 220 or temperature sensors may be provided in the region of the collecting funnel 5 or collection space 6, so that the optimal throughflow rate of the pump 2 can be controlled.

A variation in the speed of the pump 2 and of the drive device 3 may be provided via frequency converters or via hydraulic speed converters in the underwater range.

Anchoring devices 140 may be provided on the casing 10 so that the collecting funnel 5 and therefore the underwater assembly 1 can be anchored at the outlet point of the process medium. The casing 10 has an essentially bell-shaped cross-sectional shape, at the center of which the module 4 is arranged.

The invention claimed is:

1. Underwater conveying assembly comprising:

a pump;

a drive device connected to drive the pump, the drive device being sealed off with respect to the surrounding water and with respect to a process medium;

the pump and the drive device being combined into a module, and the pump having at least two inlet ports and at least one outlet port;

a casing which widens downwardly to form a collecting element, the module being arranged within the casing and the collecting element, between the casing and the module a collection space is formed; and at least one suction tube which extends in the axial extent of the pump and is arranged extending inside the collecting element so that it can be introduced into a conveying hole and is flow-connected to one of the at least two inlet ports; and a suction pipe connected to said at least one suction tube at a first position inside the collecting element and connected to said one of the at least two inlet ports of the pump at a second position, relatively farther inside the collecting element than said first position, wherein a first flow path comprises said at least one suction tube, said suction pipe and at least one of said inlet ports in sequence and a second flow path comprises said collection space, said suction pipe, and at least one of said inlet ports in sequence, and wherein the pump is configured to receive process medium through either of said first and second flow paths individually and from both of said paths simultaneously.

2. Underwater conveying assembly according to claim 1, wherein the collection space is designed as an annular space around the module.

3. Underwater conveying assembly according to claim 1, wherein the collecting element is designed as a funnel, as a bell or as a funnel-like device which tapers in the direction of said at least two inlet ports.

4. Underwater conveying assembly according to claim 1, wherein the suction pipe and the suction tube are flow-connected to one another.

5. Underwater conveying assembly according to claim 4, further comprising an adjustable valve is provided which controls the distribution of the throughflow quantity from the suction pipe and the suction tube to said at least two inlet ports.

6. Underwater conveying assembly according to claim 1, further comprising sensor devices on the collecting element for detecting the temperature, the outlet pressure and/or the concentration of admixtures in the surrounding water to make possible the positioning of the underwater conveying assembly above an outlet point of hydrocarbons.

7. Underwater conveying assembly according to claim 1, further comprising devices for treating the process medium, for the separation of solids and/or for the supply of aggregates are located in the collecting element.

8. Underwater conveying assembly according to claim 1, further comprising a recirculation line from a pressure space of the pump to a suction space of the pump through which a separated liquid phase is delivered to a suction space of the pump in a metered way in order to avoid dry running in the event of a predominant conveyance of gas phases.

9. Underwater conveying assembly according to claim 1, further comprising at least one nonreturn valve connecting an inlet side and an outlet side of the underwater conveying assembly which ensures a free passage of the process medium, even when the pump is not activated.

10. Underwater conveying assembly according to claim 1, further comprising heating devices arranged in the collecting element or in said collection space.

11. Underwater conveying assembly according to claim 1, further comprising anchoring devices arranged on the collecting element or said casing.

12. Underwater conveying assembly according to claim 1, wherein the suction tube projects beyond the height of the collecting element.

13. Underwater conveying assembly according to claim 1, wherein the pump is a screw spindle pump.

14. Underwater conveying assembly, comprising:

a pump;

a drive device connected to drive the pump, the drive device being sealed off with respect to the surrounding water and with respect to a process medium;

the pump and the drive device being combined into a module, and the pump having at least one inlet port and at least one outlet port;

a casing which widens downwardly to form a collecting element, the module being arranged within the casing and the collecting element, between the casing and the module a collection space is formed; and at least one suction tube which extends in the axial extent of the pump and is arranged extending inside the collecting element so that it can be introduced into a conveying hole and is flow-connected to the at least one inlet port; and a suction pipe connected to said at least one suction tube at a first position inside the collecting element and connected to said at least one inlet port of the pump at a second position, said suction pipe having at least one inlet relatively farther inside the collecting element that said first position, wherein a first flow path comprises said at least one suction tube, said suction pipe, and said at least one inlet port in sequence, and a second flow path comprises said collection space, said inlet, said suction pipe, and said at least one inlet in sequence, and wherein the pump is configured to receive the process medium through said either of said first and second flow paths individually and from both of said paths simultaneously.

* * * * *